US011407243B2

(12) United States Patent
Ito et al.

(10) Patent No.: US 11,407,243 B2
(45) Date of Patent: Aug. 9, 2022

(54) IMAGE FORMING SYSTEM AND METHOD TO CONTROL AN IMAGE FORMING SYSTEM

(71) Applicant: Brother Kogyo Kabushiki Kaisha, Nagoya (JP)

(72) Inventors: Tsuyoshi Ito, Nagoya (JP); Masao Mimoto, Kitanagoya (JP); Yasuo Ono, Nagoya (JP); Satoru Arakane, Nagoya (JP); Hirotoshi Maehira, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 170 days.

(21) Appl. No.: 16/929,368

(22) Filed: Jul. 15, 2020

(65) Prior Publication Data

US 2021/0023858 A1 Jan. 28, 2021

(30) Foreign Application Priority Data

Jul. 24, 2019 (JP) ..... JP2019-136137

(51) Int. Cl.
*B41J 13/00* (2006.01)
*B41J 3/60* (2006.01)

(52) U.S. Cl.
CPC ..... *B41J 13/009* (2013.01); *B41J 3/60* (2013.01); *B41J 13/0009* (2013.01)

(58) Field of Classification Search
CPC ..... B41J 13/009; B41J 3/60; B41J 13/0009
See application file for complete search history.

(56) References Cited

U.S. PATENT DOCUMENTS 5,772,343 A * 6/1998 Beretta ..... B41J 13/009 400/636
2011/0211030 A1* 9/2011 Nitta ..... B41J 3/60 347/102
2014/0092162 A1 4/2014 Nishihara

FOREIGN PATENT DOCUMENTS

JP 2004-314506 A 11/2004
JP 2008-183719 A 8/2008
JP 2014-080011 A 5/2014

* cited by examiner

*Primary Examiner* — Henok D Legesse
(74) *Attorney, Agent, or Firm* — Burr & Brown, PLLC

(57) ABSTRACT

An image forming system, having a recording head, a sheet conveyer, an inverting mechanism, and a controller, is provided. The sheet conveyer conveys a sheet in a sheet-conveying direction. The sheet is nipped at nipping points located at positions upstream and downstream in the sheet-conveying direction with respect to a discharging position. The inverting mechanism inverts the sheet from a first side to the second side. The controller determines an initial arrangement of the sheet in the sheet conveyer where image-forming on the second side starts, and controls a length of a period between time, when image-forming on the first side of the sheet in the posture with the first side facing the recording sheet is completed, and time, when the image-forming on the second side of the sheet inverted and refed to the sheet conveyer starts, based on the determined initial arrangement of the sheet in the sheet conveyer.

12 Claims, 9 Drawing Sheets

IMAGE FORMING SYSTEM AND METHOD TO CONTROL AN IMAGE FORMING SYSTEM

CROSS REFERENCE TO RELATED APPLICATION

This application claims priority under 35 U.S.C. § 119 from Japanese Patent Application No. 2019-136137, filed on Jul. 24, 2019, the entire subject matter of which is incorporated herein by reference.

BACKGROUND

Technical Field

The following description is related to an image forming system and a method to control the image forming system.

Related Art

An inkjet printer capable of double-sided printing to form images on one and the other side of a sheet in ink is known. The inkjet printer may print the image on the one side of the sheet and may wait for the ink to dry on a surface of the first side of the sheet before starting to print another image on the other side of the sheet.

The inkjet printer may set a waiting period in accordance with printing coverage on the surface of the first side of the sheet, and after printing the image on the one side and waiting for the waiting period to elapse, the inkjet printer may restart conveying the sheet so that the ink may be restrained from adhering to conveyer rollers and being transferred onto the sheet. Thereby, an image forming quality, which may otherwise be lowered, may be maintained.

SUMMARY

As an inkjet printer discharges ink droplets at a sheet, an amount of moisture in the sheet may vary unevenly part by part depending on a shape of the image being printed, and the sheet may deform or warp partially. Due to the deformation of the sheet, a distance between the sheet containing the discharged ink and a discharging nozzle in a recording head may vary, and landing positions for the ink droplets on the sheet may deviate from intended positions. Thus, the quality of the image formed on the sheet may be lowered. In this regard, in order to restrain the quality of the image from lowering, allowing the ink to dry on the sheet may be important.

Meanwhile, setting a unified length to the waiting period for the ink to dry may extend an overall processing time for printing.

An aspect of the present disclosure is advantageous in that an image forming system, capable of double-sided printing and reducing a processing time for the image printing while considering dehydration of the ink, and a method to control the image forming system, are provided.

According to an aspect of the present disclosure, an image forming system, having a recording head, a sheet conveyer, an inverting mechanism, and a controller, is provided. The recording head is configured to discharge ink to form an image on a sheet. The sheet conveyer is configured to convey the sheet nipped at a plurality of nipping points in a sheet-conveying direction. The plurality of nipping points are located at positions upstream and downstream in the sheet-conveying direction with respect to a discharging position for the recording head to discharge the ink toward the sheet. The sheet conveyer is configured to convey the sheet fed from upstream to downstream in the sheet-conveying direction. The inverting mechanism is configured to invert the sheet, having been conveyed by the sheet conveyer in a posture with a first side thereof facing the recording head, to refeed to the sheet conveyer in a posture with a second side thereof facing the recording head. The controller is configured to control the recording head, the sheet conveyer, and the inverting mechanism. The controller is configured to determine an initial arrangement of the sheet in the sheet conveyer, the initial arrangement being an arrangement where image-forming on the second side of the sheet after being refed to the sheet conveyer starts, and control a length of a period between time, when image-forming on the first side of the sheet being conveyed by the sheet conveyer in the posture with the first side facing the recording sheet is completed, and time, when the image-forming on the second side of the sheet inverted by the inverting mechanism and refed to the sheet conveyer starts, based on the determined initial arrangement of the sheet in the sheet conveyer.

According to another aspect of the present disclosure, a method to control an image forming system, having a recording head, a sheet conveyer, and an inverting mechanism, is provided. The recording head is configured to discharge ink to form an image on a sheet. The sheet conveyer is configured to convey the sheet nipped at a plurality of nipping points in a sheet-conveying direction. The plurality of nipping points are located at positions upstream and downstream in the sheet-conveying direction with respect to a discharging position for the recording head to discharge the ink toward the sheet. The sheet conveyer is configured to convey the sheet fed from upstream to downstream in the sheet-conveying direction. The inverting mechanism is configured to invert the sheet, having been conveyed by the sheet conveyer in a posture with a first side thereof facing the recording head, to refeed to the sheet conveyer in a posture with a second side thereof facing the recording head. The method includes determining an initial arrangement of the sheet in the sheet conveyer, the initial arrangement being an arrangement where image-forming on the second side of the sheet after being refed to the sheet conveyer starts, and controlling a length of a period between time, when image-forming on the first side of the sheet being conveyed by the sheet conveyer in the posture with the first side facing the recording sheet is completed, and time, when the image-forming on the second side of the sheet inverted by the inverting mechanism and refed to the sheet conveyer starts, based on the determined initial arrangement of the sheet in the sheet conveyer.

BRIEF DESCRIPTION OF THE ACCOMPANYING DRAWINGS

DETAILED DESCRIPTION

Hereinafter, with reference to the accompanying drawings, an embodiment according to an aspect of the present disclosure will be described in detail.

It is noted that various connections may be set forth between elements in the following description. These connections in general and, unless specified otherwise, may be direct or indirect, and this specification is not intended to be limiting in this respect. Aspects of the disclosure may be implemented in computer software as programs storable on computer readable media including but not limited to a random access memory (RAM), a read-only memory (ROM), a flash memory, an electrically erasable ROM (EEPROM), a CD-media, DVD-media, temporary storage, hard disk drives, floppy drives, permanent storage, and the like.

Figure 1:
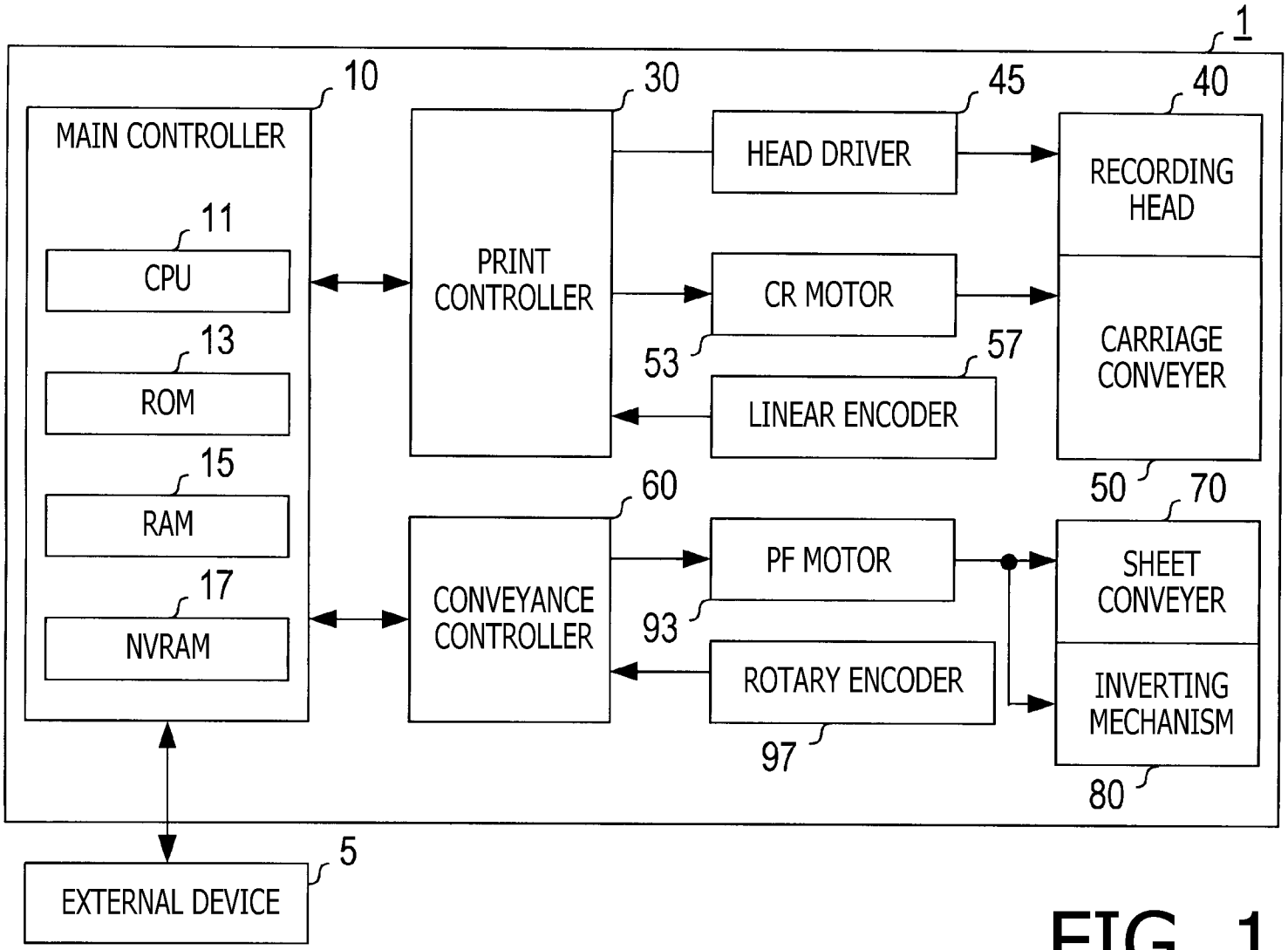
FIG. 1 is a block diagram to illustrate a configuration of an image forming system according to an embodiment of the present disclosure.

An image forming system 1 in the present embodiment shown in FIG. 1 is an inkjet printer having a main controller 10, a print controller 30, a recording head 40, a head driver 45, a carriage conveyer 50, a carriage (CR) motor 53, a linear encoder 57, a conveyance controller 60, a sheet conveyer 70, an inverting mechanism 80, a paper-feed (PF) motor 93, and a rotary encoder 97.

The main controller 10 includes a CPU 11, a ROM 13, a RAM 15, and an NVRAM 17 and may control overall actions in the image forming system 1. The CPU 11 executes processes in accordance with computer programs, which may be stored in the ROM 13. The RAM 15 may provide a work area for the CPU 11 to run the computer programs. The NVRAM 17 may include a flash memory and/or an EEPROM and store various kinds of data therein. In the following paragraphs, processes to be conducted by the main controller 10 may be implemented by the CPU 11 running the computer programs.

The main controller 10 may communicate with an external device 5, which may be, for example, a personal computer to receive image data. The main controller 10 controls, in order to form or print an image based on the image data received from the external device 5 on a sheet Q, the recording head 40, the carriage conveyer 50, the sheet conveyer 70, and the inverting mechanism 80 through the print controller 30 and the conveyance controller 60.

The print controller 30 may control a head driver 45, which may drive the recording head 40, to control actions to discharge ink droplets through the recording head 40. The print controller 30 may control the CR motor 53 to control the carriage conveyer 50. The CR motor 53 may be a direct current motor and is connected with the carriage conveyer 50 to serve as a driving source for the carriage conveyer 50.

The carriage conveyer 50 includes a carriage 51 (see FIG. 2), on which the recording head 40 is mounted. The carriage conveyer 50 may be driven by the CR motor 53 to move the carriage 51 to reciprocate along a main scanning direction. The main scanning direction coincides with an X-axis direction shown in FIG. 2, in other words, a direction of normal line to the plane of FIG. 2.

The print controller 30 may detect a position of the carriage 51 in the main scanning direction and a velocity of the carriage 51 based on encoder signals output from the linear encoder 57, and based on the detected position and the velocity, control the CR motor 53. Thus, the reciprocating movement of the carriage 51 and the recording head 40 may be enabled under the control of the CR motor 53.

The conveyance controller 60 may control the PF motor 93 to control the sheet conveyer 70 and the inverting mechanism 80. The PF motor 93 may be a direct current motor and is connected with the sheet conveyer 70 and the inverting mechanism 80 to serve as a driving source for the sheet conveyer 70 and the inverting mechanism 80.

Figure 2:
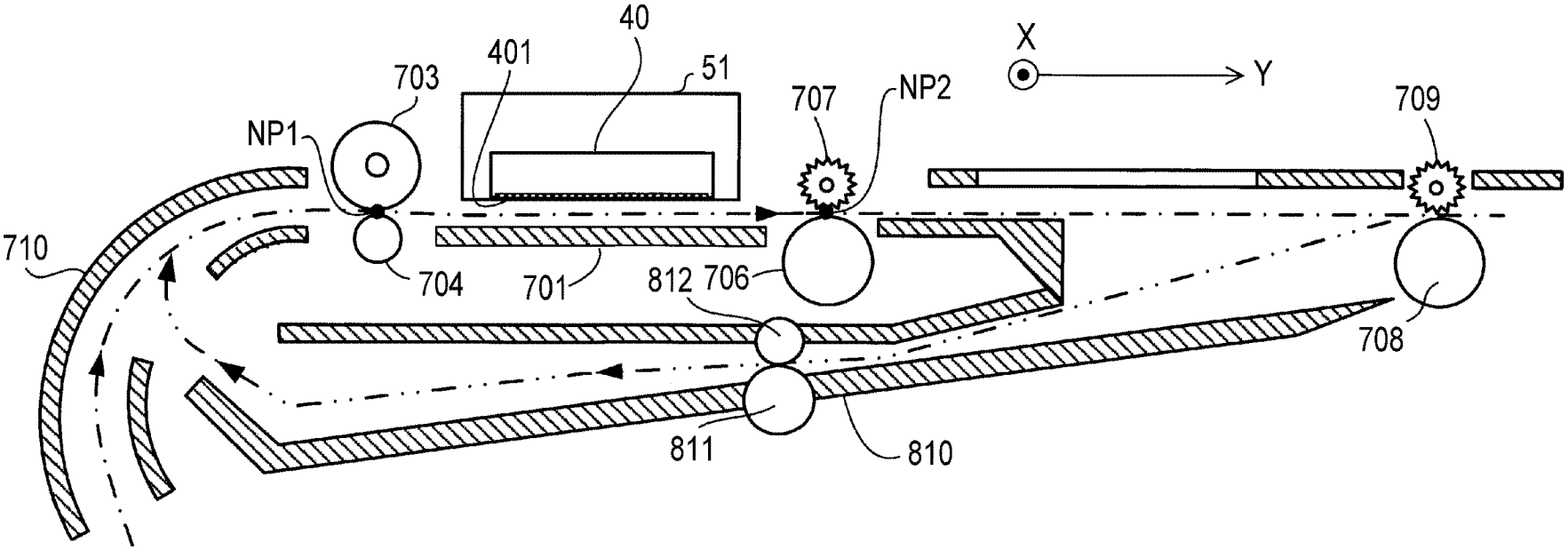
FIG. 2 is an illustrative view of a sheet conveyer and an inverting mechanism in the image forming system according to the embodiment of the present disclosure.

As shown in FIG. 2, the sheet conveyer 70 includes a platen 701, which is arranged at a position below the recording head 40, to support the sheet Q from below. In other words, an upper surface of the platen 701 may serve as a supporting surface to support the sheet Q.

The sheet conveyer 70 includes a conveyer roller 703 and a pinch roller 704, which form a first roller pair. The conveyer roller 703 and the pinch roller 704 are arranged to face each other at a position upstream from the platen 701 in a conveying direction to convey the sheet Q. The conveying direction coincides with a sub-scanning direction, which corresponds to a Y-axis direction shown in FIG. 2. The Y-axis direction intersects orthogonally with X-axis direction being the main scanning direction.

The sheet conveyer 70 further includes a first ejection roller 706 and a first spur roller 707 forming a second roller pair. The first ejection roller 706 and the first spur roller 707 are arranged to face each other at a position downstream from the platen 701 in the sub-scanning direction being the conveying direction. Moreover, the sheet conveyer 70 includes a second ejection roller 708 and a second spur roller 709, which are arranged to face each other at a position further downstream from the first ejection roller 706 and the first spur roller 707.

The inverting mechanism 80 includes an inverting path 810 at a lower position with respect to the platen 701. The inverting mechanism 80 may convey the sheet Q exiting the sheet conveyer 70 along the inverting path 810 and refeed the sheet Q to the sheet conveyer 70 from an upstream side in the sub-scanning direction.

As shown in FIG. 2, the inverting mechanism 80 includes an inverting roller 811 and a driven roller 812, which are arranged to face each other in the inverting path 810. The inverting roller 811 is, as well as the first ejection roller 706 and the second ejection roller 708, connected with the PF motor 73 through a driving force transmitter (not shown). The inverting roller 811 is rotatable in a single regular direction.

A dash-and-dot line and a dash-and-double-dots line in FIG. 2 show paths for the sheet Q to move there-along. The sheet conveyer 70 may, by controlling rotation of a feed roller (not shown), separate the sheet Q from other sheets Q stacked on a feeder tray (not shown), convey the separated sheet Q along a feeder path 710, and feed the sheet Q to a nipping point NP1 between the conveyer roller 703 and the pinch roller 704.

The conveyer roller 703 is rotatable bi-directionally. In particular, the conveyer roller 70 may rotate in a normal direction when the PF motor 93 rotates in a normal direction and may rotate in a reverse direction when the PF motor 93 rotates in a reverse direction. The conveyer roller 703 may, when rotating in the normal direction according to the normal rotation of the PF motor 93, convey the sheet Q at the nipping point NP1 downstream in the sub-scanning direction. The conveyer roller 703 nipping the sheet Q at the nipping point NP 1 together with the pinch roller 704 may convey the sheet Q downstream by rotating.

The sheet Q being conveyed downstream by the rotation of the conveyer roller 703 may be supported by the platen 701 from below and travel through an area above the platen 701, in which the sheet Q may face discharging nozzles 401 in the recording head 40. The sheet Q may be conveyed further to exit the area above the platen 701 downstream, at which the first ejection roller 706 is arranged.

The sheet Q exiting the area below the recording head 40 may be nipped by the first ejection roller 706 and the first spur roller 707. While the first ejection roller 706 is driven to rotate by the PF motor 93, the sheet Q may be conveyed by the rotation of the first ejection roller 706 downstream. The first ejection roller 706 is rotatable bi-directionally, similarly to the conveyer roller 703, and may rotate in a normal direction when the PF motor rotates in the normal direction and may rotate in a reverse direction when the PF motor rotates in the reverse direction. The first ejection roller 706 rotating in the normal direction may convey the sheet Q downstream in the sub-scanning direction.

Moreover, the second ejection roller 708 is rotatable bi-directionally. The second ejection roller 708 may, similarly to the first ejection roller 706, rotate in a normal direction when the PF motor 93 rotates in the normal direction and may rotate in a reverse direction when the PF motor 93 rotates in the reverse direction.

In other words, when the second ejection roller 708 is driven by the PF motor 93 and rotates in the normal direction, the second ejection roller 708 may convey the sheet Q, having been conveyed by the first ejection roller 706 and reached the second ejection roller 708, further downstream. At a position further downstream from the second ejection roller 708, arranged is an ejection tray (not shown).

After a printing process to print an image on one side, e.g., a first side, of the sheet Q, in order to print another image on the other side, e.g., a second side, of the same sheet Q, the sheet Q may be conveyed to the first ejection roller 706, and once the sheet Q passes through the first ejection roller 706, rotating directions of the PF motor 93 may be switched, and the second ejection roller 708 may rotate in the reverse direction. The second ejection roller 708 rotating in the reverse direction may convey the sheet Q toward the inverting path 810.

Figure 3A:
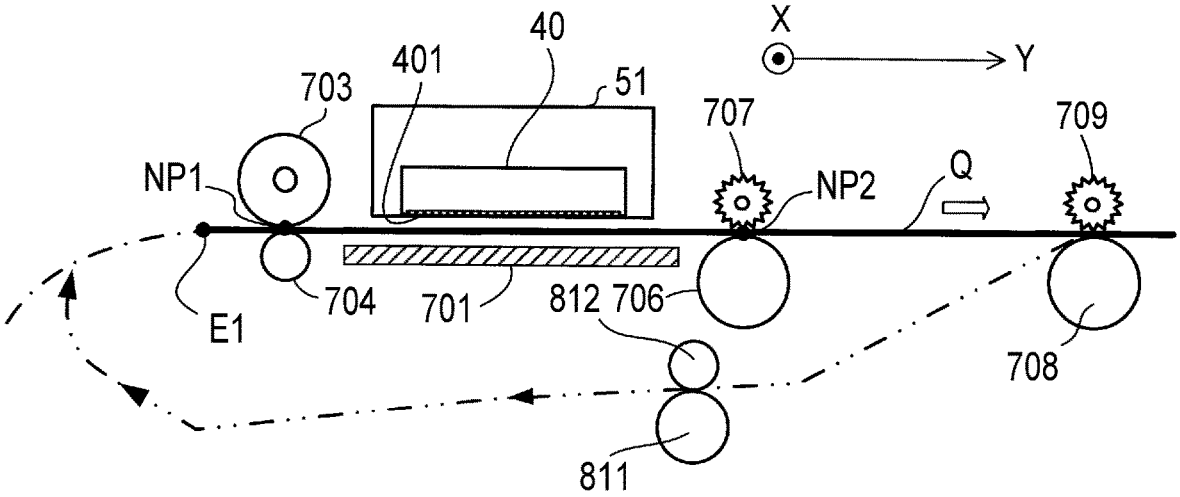
FIG. 3A is an illustrative view of a sheet being conveyed for image-printing on a first side thereof in the image forming system according to the embodiment of the present disclosure.
Figure 3B:
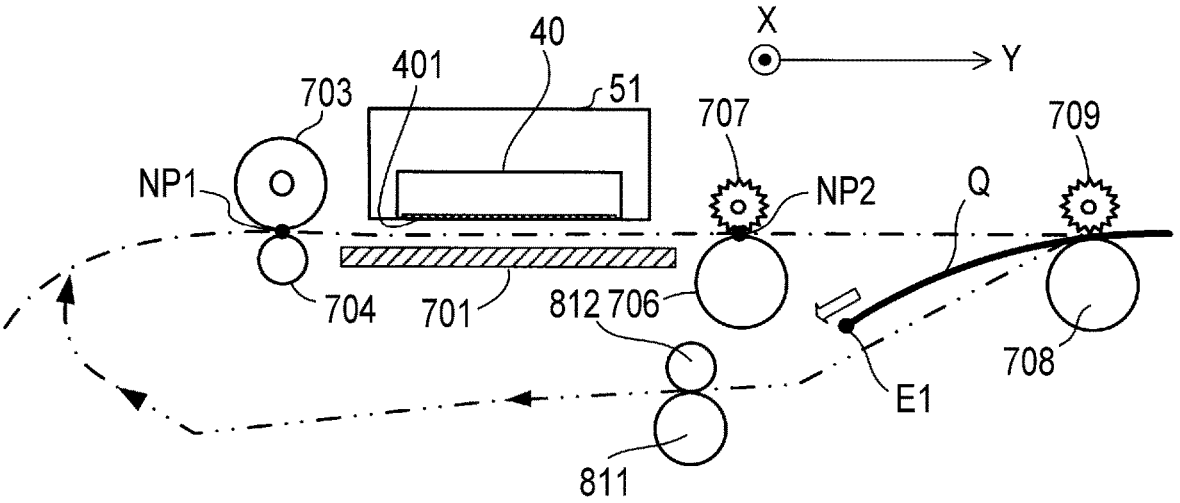
FIG. 3B is an illustrative view of the sheet being directed to an inverting path in the image forming system according to the embodiment of the present disclosure.

In particular, as the sheet Q moves downstream, a trailing end E1 of the sheet Q1 on an upstream side in the sub-scanning direction (see FIG. 3A) moves beyond the first ejection roller 706 and the first spur roller 707 (see FIG. 3B). When the trailing end E1 of the sheet Q passes through the nipping point NP2 between the first ejection roller 706 and the first spur roller 707, the rotating direction of the second ejection roller 708 is switched to the reverse direction. As the second ejection roller 708 starts rotating in the reverse direction, the sheet Q moves along the inverting path 810 as indicated by a thick arrow shown in FIG. 3B to return to the upstream side in the sub-scanning direction.

Figure 4:
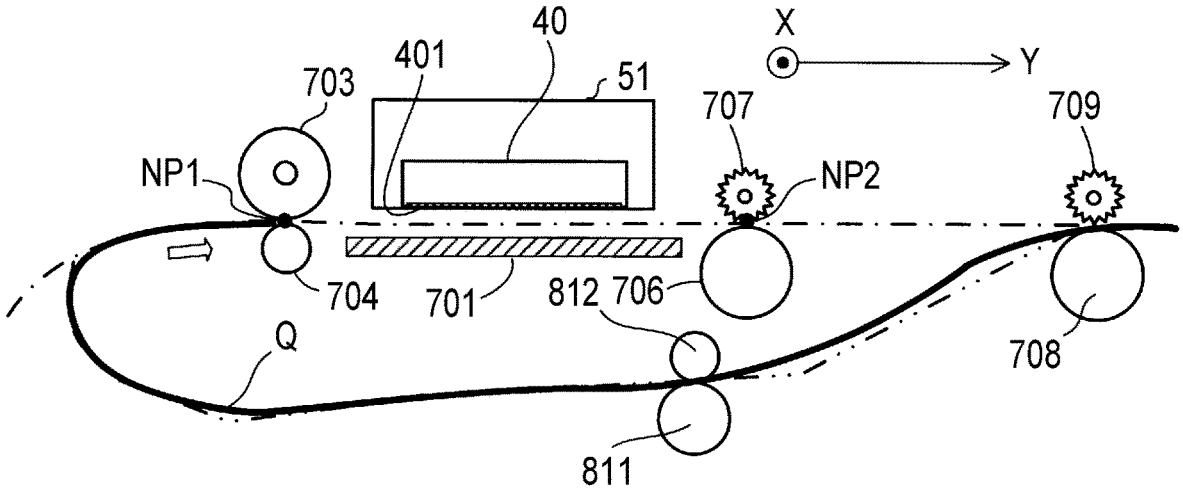
FIG. 4 is an illustrative view of the sheet to be refed to the sheet conveyer through the inverting path in the image forming system according to the embodiment of the present disclosure.

Thus, by the reverse rotation of the second ejection roller 708, the sheet Q conveyed along the inverting path 810 may be fed to a position between the inverting roller 811 and the driven roller 812, and by a force from the inverting roller 811, the sheet Q may move further along the inverting path 810 to a merging point to merge with a feeding path 710 (see FIG. 2). The sheet Q may further move along the feeding path 710 and, as shown in FIG. 4, may be refed to the sheet conveyer 70 to reenter the nipping point NP1 between the conveyer roller 703 and the pinch roller 704 in the sheet conveyer 70.

Thus, the sheet Q moving through the inverting path 810 and the feeding path 710 reaching the nipping point NP1 may be refed to the sheet conveyer 70 in a vertically inverted (upside-down) posture. As the sheet Q reenters the sheet conveyer 70, the conveyer roller 703 is controlled to rotate in the reverse direction so that a frontal edge of the sheet Q may abut on the conveyer roller 703. Thus, the conveyer roller 703 rotating in the reverse direction may restrict the refed sheet Q from being conveyed downstream beyond the nipping point NP1 and the sheet Q may pause for a while. The rotating direction of the PF motor 93 may be switched to the normal direction thereafter.

Figure 5A:
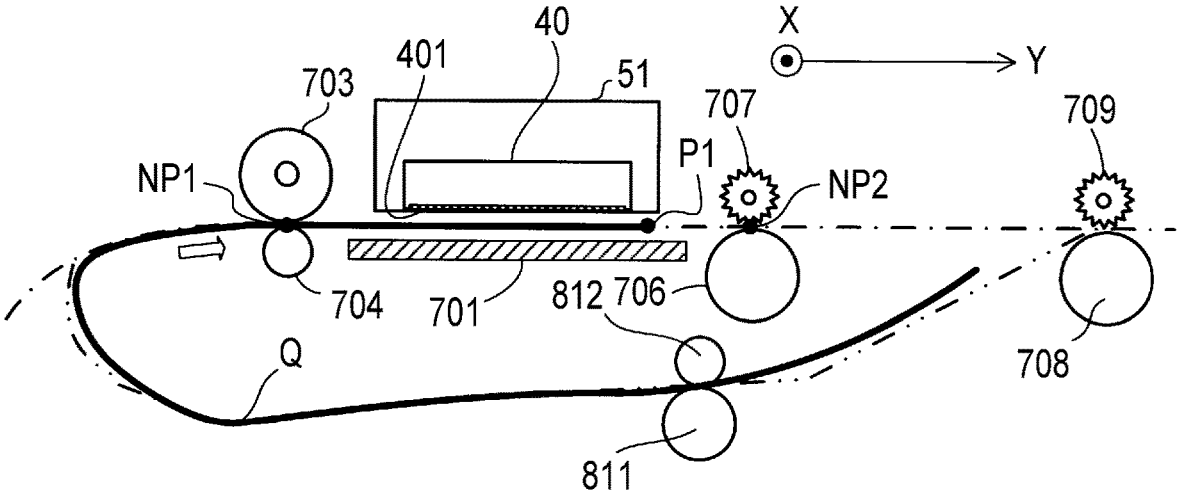
FIGS. 5A-5B are illustrative views of a first arrangement and a second arrangement of the sheet, respectively, set up in an initial arrangement before starting a printing process to a second side in the image forming system according to the embodiment of the present disclosure.
Figure 5B:
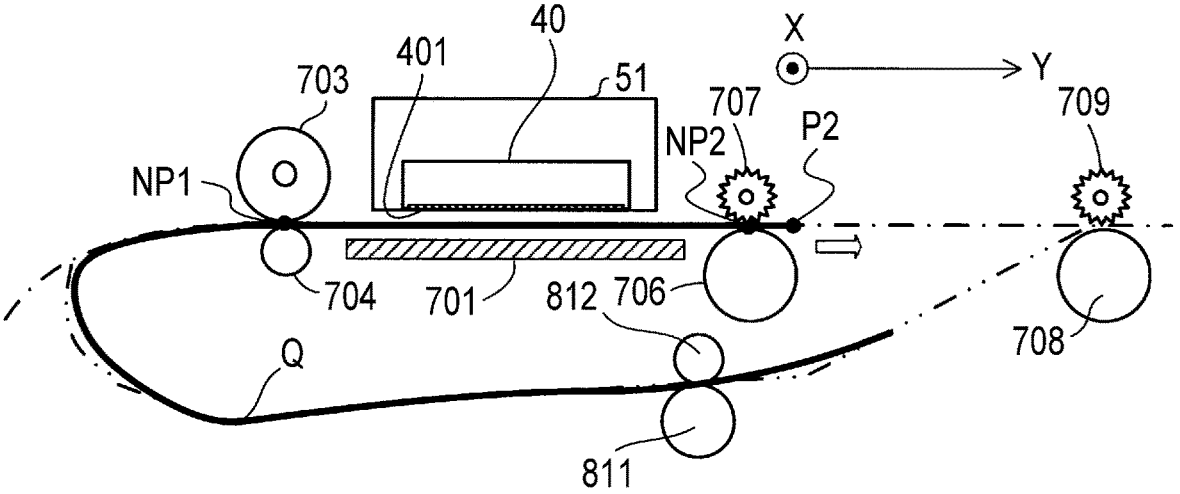

When the rotating direction of the PF motor 93 is switched to the normal direction, the conveyer roller 703 starts rotating in the normal direction. The conveyer roller 703 rotating in the normal direction may convey the sheet Q refed to the sheet conveyer 70 downstream in the sub-scanning direction beyond the nipping point NP 1 and set the sheet Q at a specific position to start image-printing. For example, the sheet Q may be conveyed to a point P1 to start, as shown in FIG. 5A, at a position upstream from the first ejection roller 706 in the sub-scanning direction. For another example, the sheet Q may be conveyed to a point P2 to start, as shown in FIG. 5B, at a position downstream from the first ejection roller 706 in the sub-scanning direction. The position of the sheet Q to start printing may vary depending on a position of the image to be printed on the side sheet Q.

The sheet Q set at the starting position may be thereafter processed through for image printing in a printing process for the second side. After the printing process to the second side is completed, the sheet Q may be ejected outside to rest on an ejection tray (not shown), which is arranged downstream from the second ejection roller 708.

Figure 6:
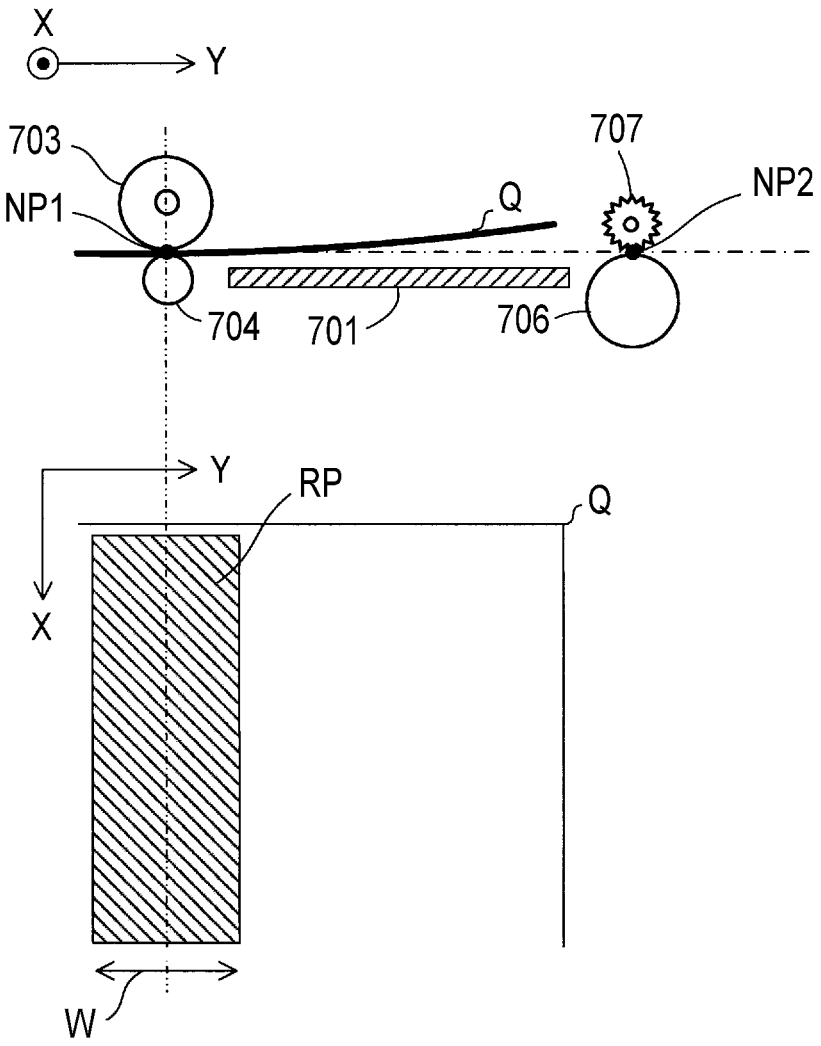
FIG. 6 is an illustrative view of a warp causable in a sheet in an image forming system.

It may be noted that, in double-sided printing, if the printing process is conducted to the second side of the sheet Q while the sheet Q with the ink discharged onto the first side is not substantially dry, the sheet Q may deform or warp upward as shown in an upper half of FIG. 6. If the image is printed on the second side of the warped sheet Q, the distance between the second side of the sheet Q and the discharging nozzles 401 in the recording head 40 may not be maintained correctly. Therefore, the ink droplets from the discharging nozzles 401 may land on positions deviated from intended positions on the sheet Q, and the quality of the image printed on the second side of the sheet Q may be lowered.

Therefore, in order to restrain the image quality from lowering, the image forming system 1 may conduct a waiting process to wait for the ink to dry before the printing process to the second side of the sheet Q starts. However, when the initial arrangement for the sheet Q after the setup is in the arrangement shown in FIG. 5B, the sheet Q is nipped between the first ejection roller 706 and the first spur roller 707 at the position downstream from the recording head 40. In this arrangement, the sheet Q may be restrained from warping. In other words, even if the printing process to the second side of the sheet Q starts while the sheet Q still contains moisture, in terms of the form of the sheet Q, the moisture may not affect the quality of the image may largely.

In this regard, the image forming system 1 may determine an initial arrangement of the sheet Q after the setup, which is, for example, one of the arrangements shown in FIGS. 5A and 5B, and a waiting time T for the ink to dry may be adjusted in accordance with the determined initial arrangement. Thereby, the waiting time T may be restrained from being unnecessarily lengthened, and a throughput for the double-sided printing may be improved. In the following paragraphs, with reference to FIGS. 7-8, a print-controlling process and a waiting-time setting process for the double-sided printing will be described.

Figure 7:
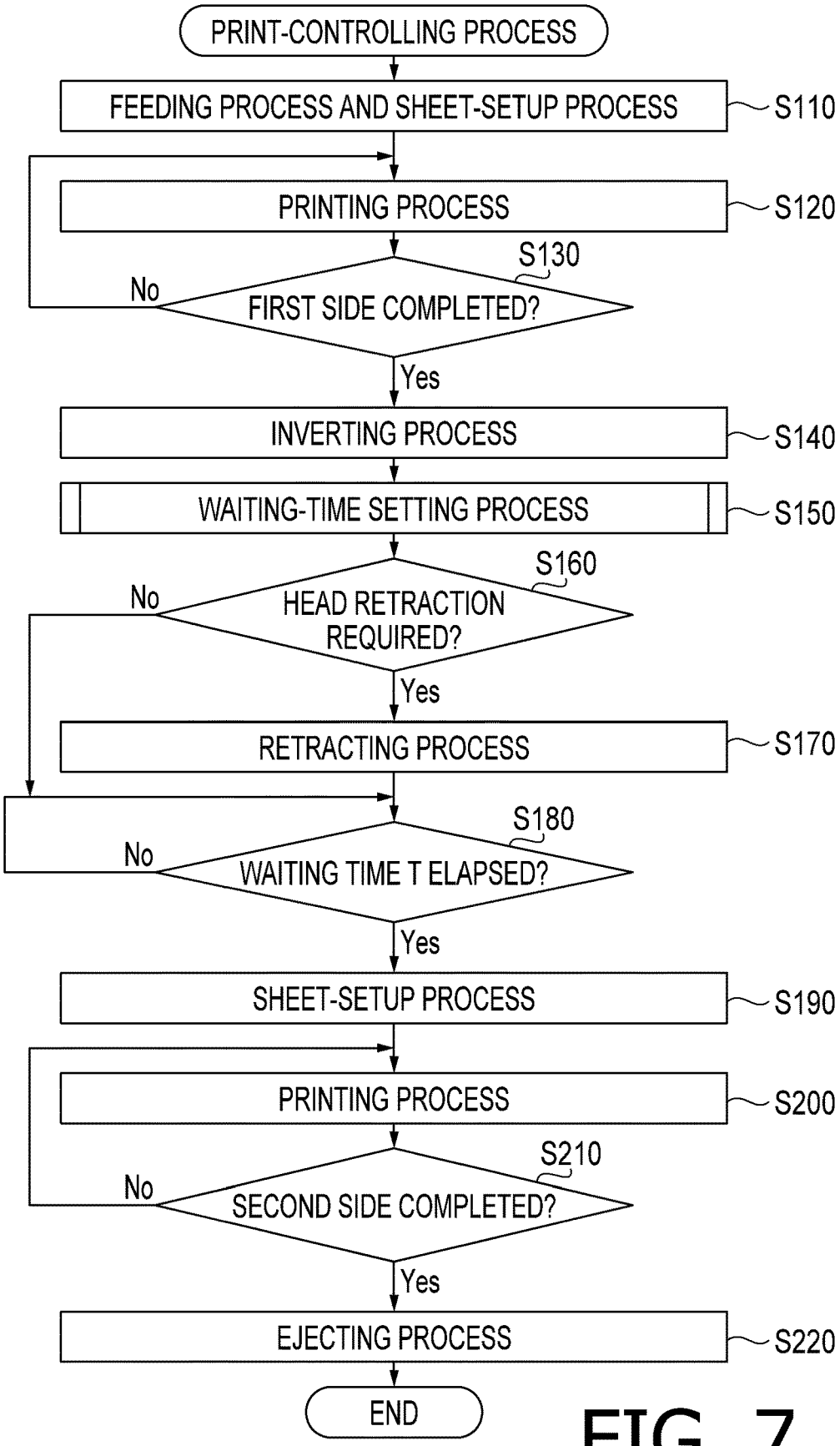
FIG. 7 is a flowchart to illustrate a flow of steps in a print-controlling process to be conducted by a main controller in the image forming system according to the embodiment of the present disclosure.
Figure 8:
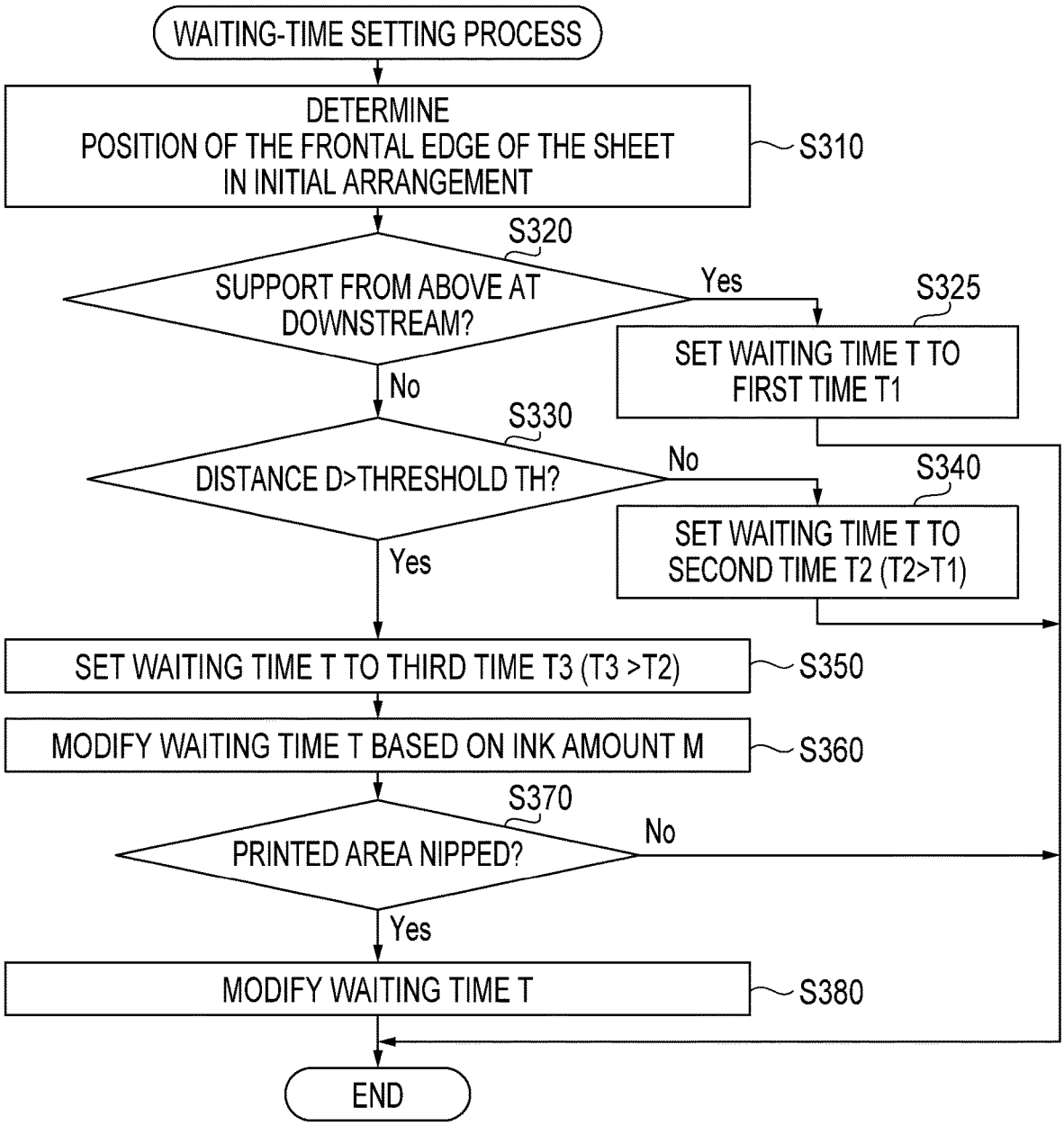
FIG. 8 is a flowchart to illustrate a flow of steps in a waiting-time setting process to be conducted by the main controller in the image forming system according to the embodiment of the present disclosure.

The main controller 10 may conduct the print-controlling process, including the waiting-time setting process, as shown in FIGS. 7-8 when a command for the double-sided printing from the external device 5 is input. As the print-controlling process starts, in S110, the main controller 10 conducts a feeding process and a sheet-setup process.

In particular, in the feeding process, the main controller 10 may control the sheet conveyer 70 through the conveyance controller 60 to feed one of the sheets Q stacked on the feeder tray to the nipping point NP1 between the conveyer roller 703 and the pinch roller 704.

Further, in the sheet-setup process, the main controller 10 may control the sheet conveyer 70 through the conveyance controller 60 to set the sheet Q being fed to the nipping point NP1 in an arrangement such that a frontal portion of an image-forming area on the first side of the sheet Q faces the recording head 40 and stays in a dischargeable area for the recording head 40. In this context, the image-forming area may be an area on the first or second side of the sheet Q, in which an image is to be printed in the printing process, and the frontal part of the image-forming area on the first side of the sheet Q may mean a downstream portion of the image-forming area on the first side in the sub-scanning direction. The dischargeable area for the recording head 40 may be an area, at which the recording head 40 discharges ink droplets through the discharging nozzles 401.

After the feeding process and the sheet-setup process, in S120, the main controller 10 conducts a printing process to the first side of the sheet Q. In particular, the main controller 10 may control the recording head 40, the carriage conveyer 50, and the sheet conveyer 70 through the print controller 30 and the conveyance controller 60 to form an image based on image data received from the external device 5 in the image-forming area on the first side of the sheet Q.

For example, the main controller 10 may control the carriage conveyer 50 through the print controller 30 to move the carriage 51 to an end along the main-scanning direction. While the carriage 51 moves along the main-scanning direction, the recording head 40 facing the sheet Q may be controlled for a discharging action to discharge ink droplets at the sheet Q to form the image in the dischargeable area that faces the recording head 40 on the sheet Q.

Moreover, after the discharging action by the recording head 40 to discharge ink droplets is completed at the end in the main-scanning direction, the main controller 10 may control the sheet conveyer 70 through the conveyance controller 60 to convey the sheet Q for a predetermined distance downstream in the sub-scanning direction. The carriage 51 may be moved to the other end in the main-scanning direction.

In S120-S130, the main controller 10 repeats the printing process until the image-forming to the entire image-forming area on the first side of the sheet Q is completed. When the main controller 10 determines that the image-forming to the entire image-forming area on the first side of the sheet Q is completed (S130: YES), the flow proceeds to S140. In S140, the main controller 10 conducts an inverting process.

In the inverting process, the main controller 10 may switch the rotating directions of the PF motor 93 through the conveyance controller 60 to control the sheet conveyer 70 and the inverting mechanism 80. In particular, the main controller 10 switches the rotating directions of the PF motor 93 to cause the second ejection roller 708 to rotate in the reverse direction and the inverting roller 811 to rotate in the regular direction so that the sheet Q may be conveyed through the inverting path 810 to be vertically inverted and refed to the nipping point NP 1 between the conveyer roller 703 and the pinch roller 704. At the time when the inverting process is completed, the frontal edge of the sheet Q pauses at the nipping point NP1 and is restricted from moving downstream further inward in the sub-scanning direction in the sheet conveyer 70 beyond the nipping point NP1.

Following S140, in S150, the main controller 10 conducts the waiting-time setting process shown in FIG. 8 to set a waiting time T, for which the printing process to the second side of the sheet Q should wait to let the ink on the first side of the sheet Q to dry. The detailed steps in the waiting-time setting process will be described later below.

In S160, the main controller 10 determines whether the recording head 40 should retract from a pathway for the sheet Q being conveyed. The main controller 10 may determine that the recording head 40 should retract from the pathway when the waiting time T is equal to or shorter than a reference time. The reference time may be equal to a length of a first time T1, which may be set in S325 (see FIG. 8) as the waiting time T. Optionally, the reference time may be sparsely longer than the first time T1 set in S325.

If the main controller 10 determines that the recording head 40 should retract (S160: YES), the flow proceeds to S170, in which the main controller 10 conducts a retracting process. In particular, the main controller 10 may control the carriage conveyer 50 through the print controller 30 to retract the recording head 40 to a maintenance position, which is set as a starting point of a movable range for the recording head 40 in the main scanning direction.

The maintenance position is located outside the pathway for the sheet Q in the main scanning direction. In other words, the maintenance position is a position, at which the recording head 40 may avoid interference with the sheet Q when the sheet Q is conveyed over the platen 701 downstream in the sub-scanning direction.

Following the retracting process in S170, the flow proceeds to S180. On the other hand, in S160, if the main controller 10 determines that the retraction of the recording head 40 is not necessary (S160: NO), the flow proceeds to S180 without conducting the retracting process in S170.

In S180, the main controller 10 awaits arrival of an end of the waiting time T set in S150, in other words, lapse of the waiting time T set in S150 since the placement of the frontal edge of the vertically inverted sheet Q to pause at the nipping point NP1. When the waiting time T elapses (S180: YES), the flow proceeds to S190, in which the main controller 10 conducts a sheet-setup process for the second side of the sheet Q.

In particular, in the sheet-setup process in S190, the main controller 10 may control the sheet conveyer 70 through the conveyance controller 60 to set the sheet Q being fed to the nipping point NP1 in an arrangement such that a frontal portion of an image-forming area on the second side of the sheet Q faces the recording head 40 and stays in the dischargeable area for the recording head 40.

Following the sheet-setup process, in S200-S210, similarly to S120-S130, the main controller 10 repeats the printing process until the image-forming to the entire image-forming area on the second side of the sheet Q is completed. When the main controller 10 determines that the image-forming to the entire image-formable area on the second side of the sheet Q is completed (S210: YES), the flow proceeds to S220, in which the main controller 10 conducts an ejecting process.

In the ejecting process, the main controller 10 controls the sheet conveyer 70 through the conveyance controller 60 to eject the sheet Q to rest on the ejection tray. Thereafter, the main controller 10 ends the print-controlling process.

In the following paragraphs, the waiting-time setting process in S150 will be described with reference to FIG. 8. As the waiting-time setting process starts in S150, in S310, the main controller 10 determines a position of the frontal edge of the sheet Q when the main controller conducts the sheet-setup process later in S190 (see FIG. 7) prior to the printing process to the second side of the sheet Q in S200. In other words, the main controller 10 determines a position of a downstream edge of the sheet Q in the sub-scanning direction after the sheet-setup process that will be conducted later.

In S310, the main controller 10 may calculate the position of the frontal edge of the sheet Q after the setup based on, for example, a distance of a margin in the sub-scanning direction between the image-forming area on the second side of the sheet Q and the frontal edge of the sheet Q.

More specifically, the main controller 10 may refer to the image data for the image to be printed on the second side of the sheet Q and calculate a distance in the sub-scanning direction between the frontal edge of the sheet and an area, in which data for a dot for the image is provided. Based on this calculated distance, the main controller 10 may thereafter estimate at least one of a distance between the frontal edge of the sheet Q after the setup and the nipping point NP1 and a distance between the frontal edge of the sheet Q after the setup and the nipping point NP2. Based on the estimated distance(s), the main controller 10 may determine a position of the frontal edge of the sheet Q relative to the nipping points NP1, NP2, or the initial arrangement of the sheet Q.

Based on the position of the frontal edge of the sheet Q determined in S310, in S320, the main controller 10 determines whether the sheet-setup process in S190 will place the sheet Q in an arrangement such that the sheet Q is supported to be suppressed from above at a position downstream from the recording head 40 in the sub-scanning direction. In other words, the main controller 10 may determine whether the determined position of the frontal edge is downstream from the nipping point NP2, which is between the first ejection roller 706 and the first spur roller 707.

For example, when the determined position of the frontal edge of the sheet Q is downstream from the nipping point NP2, the sheet Q is in an arrangement such that the sheet Q is supported by the nipping force between the first ejection roller 706 and the first spur roller 707 to be restricted from warping upward.

If the main controller 10 determines that the sheet Q will be arranged to be suppressed from above (S320: YES), in S325, the main controller 10 sets the waiting time T to the first time T1. The first time T1 is a shortest waiting time T among times that may be set for the waiting time T. Optionally, in S325, the waiting time T may be set to zero (0). After S325, the main controller 10 exits the waiting-time setting process and proceeds to S160 (see FIG. 7).

Figure 9:
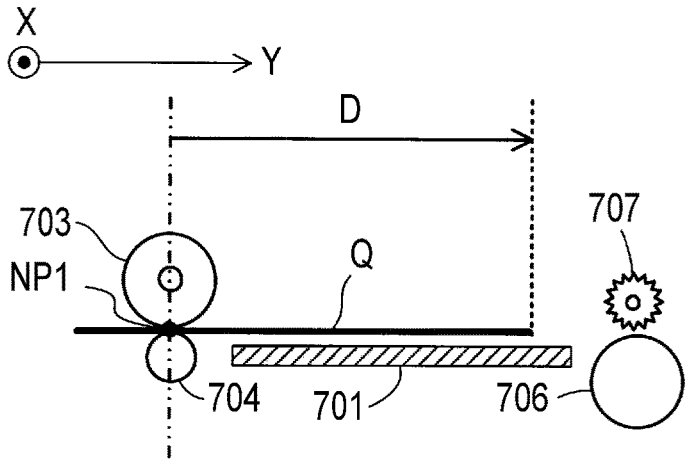
FIG. 9 is an illustrative view of a distance between a nipping point and the leading edge of the sheet in the image forming system according to the embodiment of the present disclosure.

On the other hand, in S320, if the main controller 10 determines that the sheet Q will not be arranged to be suppressed from above (S320: NO), the flow proceeds to S330. In S330, the main controller 10 determines whether a distance D (see FIG. 9) from the nipping point NP1, which is between the conveyer roller 703 and the pinch roller 704, to the frontal edge of the sheet Q in the sub-scanning direction is greater than a threshold value TH.

If the distance D is equal to or smaller than the threshold value TH (S330: NO), in S340, the main controller 10 sets the waiting time T to a second time T2. After S340, the main controller 10 exits the waiting-time setting process and proceeds to S160 (see FIG. 7).

The second time T2 is longer than the first time T1. In particular, the second time T2 may be set to have a length, in which the ink should dry to an extent to moderate the warp in the sheet Q substantially in terms of the image forming quality, when the distance D from the nipping point NP1 to the frontal edge of the sheet Q set up in S190 is equal to or smaller than the threshold TH. A manufacturer of the image forming system 1 may determine a suitable value for the second time T2 empirically.

In S330, if the main controller 10 determines that the distance D is greater than the threshold value TH (S330: YES), in S350, the main controller 10 sets the waiting time T to a third time T3. The third time length T3 is longer than the second time length T2 and may be set to have a length, in which the ink should dry to an extent to moderate the warp in the sheet Q substantially in terms of the image forming quality, when the distance D from the nipping point NP1 to the frontal edge of the sheet Q set up in S190 is greater than the threshold TH.

It may be noted that, if the sheets Q warp in a same inclination, the longer the distance D from the nipping point NP1 is, the higher the frontal edge of the sheet Q may be located to be closer to the discharging nozzles 401 in the recording head 40. Therefore, when the distance D is longer, in order to wait for the warp to be moderated, a longer time for the ink to dry may be required.

After S350, in S360, the main controller 10 modifies the waiting time T3 set to the third time T3 based on an ink amount M on the first side of the sheet Q. For example, if the ink amount M is equal to or less than a reference amount, the main controller 10 may not correct the waiting time T, but when the ink amount M is greater than the reference amount, the main controller 10 may correct the waiting time T by adding a predetermined length $\alpha$ to the third time T3 ($T3+\alpha$).

For another example, the main controller 10 may calculate the additional length $\alpha$ in accordance with the ink amount M, based on a function $\alpha=f(M)$, in which the ink amount M is the input variable and the additional length $\alpha$ is the output variable, and extend the waiting time T being the third time T3 ($T=T3$) by adding the additional length $\alpha$ ($T=T+\alpha$). The function f(M) may either be a monotonically increasing function or a monotonically non-decreasing function. The monotonically increasing function includes linear function, and the monotonically non-decreasing function includes step function, in which the additional length α increases stepwise in accordance with increase of the ink amount M.

Meanwhile, the ink amount M may be a liquid volume of the ink having been used for printing the image on the first side of the sheet Q, dimensions of areas, in which the image is printed, on the first side of the sheet Q, or may be a rate of the area dimensions, in which the image is printed on the first side of the sheet Q, with respect to an overall area dimension of the first side of the sheet Q. Moreover, the ink amount M may not necessarily be an amount of the ink having been used for the entire first side of the sheet Q but may be an amount of the ink having been used merely in a limited part of the first side of the sheet Q. For example, the ink amount M may be an amount of the ink having been used in an area, which may be placed in proximity to the nipping point NP1, in the sheet Q after the setup.

Meanwhile, the ink amount M may be merely an indication for adjusting the length of time for drying the ink required to moderate the warp in the sheet Q; therefore, the ink amount M may not necessarily demand strict accuracy. It may be noted that as the ink amount M increases, the longer time for the ink to dry to moderate the warp is required. The additional length α may be achieved empirically.

After S360, in S370, the main controller 10 determines whether a peripheral area around a printed area on the first side of the sheet Q is nipped between the conveyer roller 703 and the pinch roller 704. The printed area may be an area, at which the ink droplets were discharged in the printing process to the first side of the sheet Q in S120 (see FIG. 7).

For example, when an area dimension of the printed area on the first side of the sheet Q falling in a specific part RP (see FIG. 6) is equal to or greater than a predetermined dimension, the main controller 10 may make an affirmative determination in S370. The specific part RP is a hatched area in FIG. 6, which is determined to be located in a range having a width W in the sub-scanning direction and centered at the nipping portion NP1. On the other hand, when the area dimension of the printed area falling in the specific part RP is smaller than the predetermined area dimension, the main controller 10 may make a negative determination in S370.

For another example, the main controller 10 may make the determination in S370 based on an ink amount, e.g., a liquid volume of the ink, discharged at the printed area within the specific part RP on the first side of the sheet Q during the printing process. In particular, when the determined ink amount is equal to or greater than a threshold amount, the main controller 10 may make an affirmative determination in S370, but when the determined ink amount is smaller than the threshold amount, the main controller 10 may make a negative determination in S370.

It may be noted that the specific part RP shown in FIG. 6 is merely an example. The width W may either be larger or smaller than a diameter of the conveyer roller 703. For another example, the center of the width W in the sub-scanning direction may not coincide with the nipping point NP1 but may be displaced from the nipping point NP1. The specific part RP may be determined empirically.

While the ink is not substantially dry, and if the peripheral area around the printed area is nipped, the sheet Q tend to warp to a greater extent. Therefore, when the main controller 10 determines that the peripheral area is to be nipped (S370: YES), in S380, the main controller 10 may modify the waiting time T further by adding a predetermined length β and conclude the modified waiting time T being T3+α+β (T=T3+α+β) to be the length for the waiting time T.

The predetermined length β may either be a constant length or a variable length corresponding to the area dimension or the ink amount. For example, the main controller 10 may adjust the length to be added to the waiting time T based on the ink amount in the specific part PR. In other words, the main controller 10 may modify the waiting time T by adding a time β which is longer when the ink amount is greater. Thereafter, the main controller 10 may exit the waiting-time setting process and proceeds to S160 (see FIG. 7).

From S160 and onward, the main controller 10 may wait for the waiting time T being T3+α+β to elapse, and thereafter, the main controller 10 may conduct the sheet-setup process (S190) and the printing process (S200) to the second side of the sheet Q.

In S370, meanwhile, if the main controller 10 determines that the peripheral area is not to be nipped (S370: NO), the main controller 10 concludes the waiting time T after S360, which is T3+α, to be the length for the waiting time T and exits the waiting-time setting process. From S160 and onward, the main controller 10 may wait for the waiting time T being T3+α to elapse, and thereafter, conduct the sheet-setup process (S190) and the printing process (S200) to the second side of the sheet Q.

According to the image forming system 1 in the embodiment of the present disclosure, the nipping point NP1 between the conveyer roller 703 and the pinch roller 704 may serve as a first point of action to support the sheet Q from above and below at the upstream position with respect to the discharging position, where the discharging nozzles 401 discharge the ink droplets, in the sub-scanning direction. Moreover, the nipping point NP2 between the first ejection roller 706 and the first spur roller 707 may serve as a second point of action to support the sheet Q from above and below at the downstream position with respect to the discharging position, where the discharging nozzles 401 discharge the ink droplets, in the sub-scanning direction. In this regard, however, when the sheet Q is in the arrangement set in S190, the frontal edge of the sheet Q may or may not reach the nipping point NP2 to be nipped between the first ejection roller 706 and the first spur roller 707.

When the sheet Q in the arrangement set in S190 is not nipped at the nipping point NP2 between the first ejection roller 706 and the first spur roller 707, the image may be printed on the second side of the sheet Q with the frontal edge released free. Therefore, if the printing process starts before the ink is substantially dried and the warp is moderated, the quality of the image to be printed on the second side of the sheet Q may be deteriorated.

On the other hand, when the sheet Q in the arrangement set in S190 is nipped at the nipping point NP2 between the first ejection roller 706 and the first spur roller 707, the deterioration of the image quality due to the warp of the sheet Q may not occur inherently regardless of the wetness of the ink discharged at the first side of the sheet Q.

In consideration of the difference that may be caused by the arrangement of the sheet Q, the main controller 10 may determine the initial arrangement of the sheet Q, after the refeeding of the sheet Q to the sheet conveyer 70, to start the image-forming action, or the printing process, to the second side of the sheet Q. Based on the determined initial arrangement of the sheet Q, the main controller 10 may modify the waiting time T and control the length between the time, when the image printing on the first side of the sheet Q is completed, and, after the inverted sheet Q is refed to the sheet conveyer 70, the time when another image-printing on the second side of the sheet Q starts.

In particular, the main controller 10 may modify the waiting time T based on the position of the sheet Q relative to the first point of action, i.e., the nipping point NP1, and the second point of action, i.e., the nipping point NP2, to adjust the timing when the image-forming to the refed sheet Q should start.

Meanwhile, in the conventional inkjet image forming system, the waiting time to let the ink dry is set without considering the warping behavior of the sheet Q. Therefore, even in the case, where the sheet Q may be arranged after the setup at the position to be restrained from warping, as shown in FIG. 5B, the waiting time to let the ink dry was provided, and the printing process was postponed unnecessarily.

In contrast, according to the embodiment of the present disclosure, when the sheet Q after the sheet-setup process is determined to be in the arrangement such that the frontal edge is supported by the first ejection roller 706 and the first spur roller 707 at the second point of action, in which the sheet Q is restrained from warping, the waiting time T may be set to be shorter to start the printing process to the second side of the sheet Q earlier. In this regard, the image forming system 1 may provide improved throughput and image-forming quality for double-sided printing.

In particular, according to the embodiment described above, when the frontal edge of the sheet Q is not nipped at the nipping point NP2 but is released free, the waiting time T may be extended, if the distance D between the leading edge of the sheet Q and the nipping point NP1 is longer, so that the printing process to the second side of the sheet Q may start later. In other words, when the frontal edge of the sheet Q is released free, the waiting time T may be adjusted suitably in accordance with the length of the time required for the warp of the sheet Q to be moderated.

Moreover, according to the embodiment described above, the waiting time T may be adjusted in consideration of the position of the printed area on the first side of the sheet Q after the setup relative to the nipping point NP1. In particular, when the printed area is located at an actable position, in which the sheet Q may be acted upon by the force from the conveyer roller 703 and the pinch roller 704, i.e., the nipping point NP1, the waiting time T may be adjusted to be longer (S380; see FIG. 8) compared to the arrangement, in which the printed area is not located at the affected position. In this regard, the tendency of the sheet Q, which may warp to a greater extent when the printed area is nipped by the conveyer roller 703 and the pinch roller 704, may be restrained effectively by adjusting the waiting time T to let the ink dry suitably.

Moreover, according to the embodiment described above, when the waiting time T is set to the first time T1, which may be shorter than the time required to moderate the warp in the sheet Q, in S170 (see FIG. 7), the recording head 40 may be retracted from the pathway of the sheet Q before the frontal edge of the sheet Q passes through the dischargeable area for the recording head 40. Thus, the recording head 40 may not interfere with the sheet Q. Therefore, while the sheet Q may be set up in the initial arrangement in the warped posture, the sheet Q may be restrained from interfering with the nozzles 401 of the recording head 401 and may be placed in initial arrangement sooner. In other words, the throughput in printing may be improved.

Although an example of carrying out the invention has been described, those skilled in the art will appreciate that there are numerous variations and permutations of the image forming system that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described examples of modifications to the present embodiment.

For example, the warping extent of the sheet Q may vary depending on different factors such as, for example, thickness and/or material of the sheet Q. Therefore, the first time T1, the second time T2, the third time T3, the additional length α, and the additional length β may be prepared for each type of the sheet Q that may be conveyed in the image forming system 1. In other words, the image forming system 1 may store values for T1, T2, T3, α, and β for each of the types of the sheet Q that may be classified by the factors such as thickness and material in the NVRAM 17. The main controller 10 may identify the type of the sheet Q to be currently conveyed and, based on the values T1, T2, T3, α, and β prepared for the identified type of the sheet Q, conduct the waiting-time setting process shown in FIG. 8.

For another example, when the main controller 10 sets the waiting time T to the second time T2 in S340 (see FIG. 8), the main controller 10 may modify the waiting time T with use of the additional length α, β, similarly to the modification of the first time T1 in S360-S380.

Figure 10:
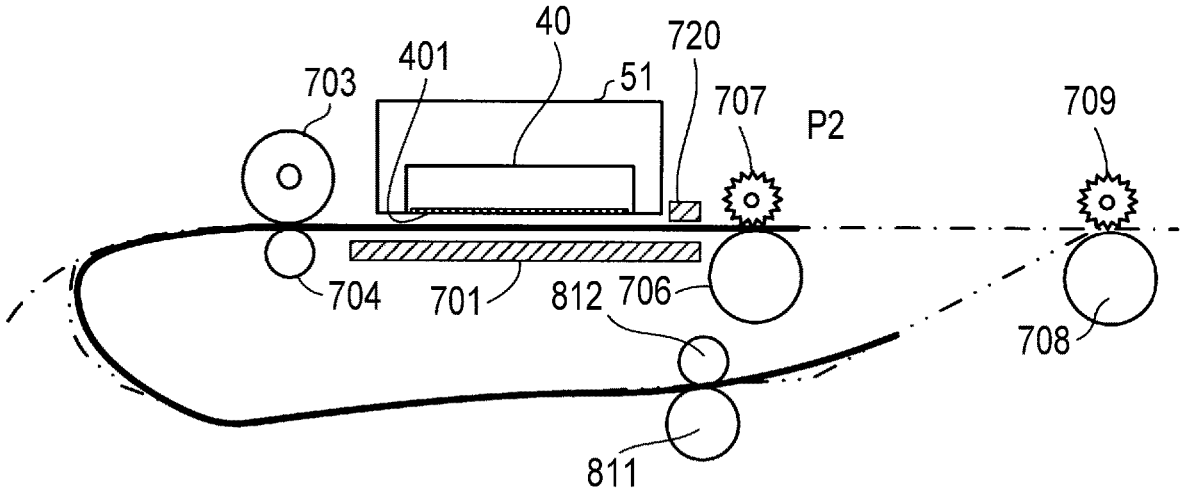
FIG. 10 is an illustrative view of a sheet conveyer with a sheet presser in the image forming system according to the embodiment of the present disclosure.

For another example, the present disclosure may be applied to an image forming system 1 as shown in FIG. 10, which has a sheet presser 720 at a position downstream from the recording head 40 and upstream from the first ejection roller 406 in the sub-scanning direction. The sheet presser 720 may press the sheet Q on the platen 701 from above. In this arrangement, in order to determine whether the sheet Q is in the arrangement, in which the sheet Q is supported from above at a position downstream from the recording head 40 in the sub-scanning direction in S320, the main controller 10 may determine whether the position of the sheet Q determined in S310 is downstream from the sheet presser 720 in the sub-scanning direction. Thus, based on this determination, the main controller 10 may set the waiting time T as shown in FIG. 8.

For another example, the inverting mechanism 80 may not necessarily be in the configuration shown in FIG. 2, but an inverting mechanism may be arranged at a position upstream from the sheet conveyer 70. For example, the first ejection roller 706 may rotate in the reverse direction to convey the sheet Q reversely upstream in the sub-scanning direction beyond an entrance of the sheet conveyer 70, and when the sheet Q reaches the inverting mechanism, the sheet Q may be inverted upside-down by the inverting mechanism and conveyed downstream in the sub-scanning direction to reenter the sheet conveyer 70.

In the embodiment described above, the image forming system 1 may control the length of the period between the time, when the printing process to the first side of the sheet Q is completed (S130), and the time, when the printing process to the second side of the sheet Q starts (S200), indirectly through the sheet-conveyance control by controlling the length of the period between the time, when the inverted sheet Q is fed to the nipping point NP1 (S140), and the time, when the sheet-setup process to the second side of the sheet Q starts (S190). However, for another example, the image forming system 1 may control the length of the period between the time, when the printing process to the first side of the sheet Q is completed, and the time, when the printing process to the second side of the sheet Q starts, by controlling the length of the period between the time, when the sheet-setup process ends, and the time, when the printing for the second side of the sheet Q starts.

For another example, the image forming system 1 may control the length of the period between the time, when the printing process to the first side of the sheet Q is completed (S130), and the time, when the printing process to the second side of the sheet Q starts (S200), by controlling the timing when the inverted sheet Q is to be refed to the nipping point NP1.

In particular, the image forming system 1 may adjust the time to start the inverting process (S140), or may adjust the conveying velocity of the sheet Q in the inverting process (S140) to control the time to start the printing process to the second side of the sheet Q. In this arrangement, the main controller 10 may conduct the waiting-time setting process (S150) prior to the inverting process (S140). Optionally, a starting point to start the waiting action, in other words, a starting point of the waiting time may be a point, when the printing process to the first side of the sheet Q is completed.

In other words, the image forming system 1 may control the length of the period between the time, when the printing process to the first side of the sheet Q is completed, and the time, when the printing process to the second side of the sheet Q starts, by controlling at least one of the recording head 40, the sheet conveyer 70, and the inverting mechanism 80.

For another example, the waiting time T may not necessarily be determined to be one of the second time T2 and the third time T3 in S330 based on the comparison between the distance D and the threshold value TH, but the waiting time T may be adjusted continuously or stepwise in a predetermine range based on the distance D.

For another example, a function achieved through a single element in the embodiment described above may not necessarily be achieved by the single element alone but may be achieved by a plurality of distributed elements. For another example, functions achieved by a plurality of elements in the embodiment described above may be unified into a single element. For another example, a part of the configuration described in the above embodiment may be omitted or replaced with another configuration, or an additional configuration may be provided to the elements in the embodiment described above.

It is to be understood that the subject matter defined in the appended claims may not necessarily be limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. An image forming system, comprising:

a recording head configured to discharge ink to form an image on a sheet;

a sheet conveyer configured to convey the sheet nipped at a plurality of nipping points in a sheet-conveying direction, the plurality of nipping points being located at positions upstream and downstream in the sheet-conveying direction with respect to a discharging position for the recording head to discharge the ink toward the sheet, the sheet conveyer being configured to convey the sheet fed from upstream to downstream in the sheet-conveying direction;

an inverting mechanism configured to invert the sheet, having been conveyed by the sheet conveyer in a posture with a first side thereof facing the recording head, to refeed to the sheet conveyer in a posture with a second side thereof facing the recording head; and a controller configured to control the recording head, the sheet conveyer, and the inverting mechanism, the controller being configured to:

determine an initial arrangement of the sheet in the sheet conveyer, the initial arrangement being an arrangement where image-forming on the second side of the sheet after being refed to the sheet conveyer starts, and control a length of a period between time, when image-forming on the first side of the sheet being conveyed by the sheet conveyer in the posture with the first side facing the recording sheet is completed, and time, when the image-forming on the second side of the sheet inverted by the inverting mechanism and refed to the sheet conveyer starts, based on the determined initial arrangement of the sheet in the sheet conveyer.

2. The image forming system according to claim 1, wherein the sheet conveyer comprises a plurality of roller pairs at positions corresponding to the plurality of nipping points, each of the plurality of roller pairs being configured to nip the sheet fed thereto and convey the nipped sheet downstream by rotating, and wherein the controller is configured to control the length of the period based on a position of the sheet relative to the plurality of roller pairs in the initial arrangement.

3. The image forming system according to claim 1, wherein the plurality of nipping points include:

a first nipping point located upstream with respect to the discharging position in the sheet-conveying direction; and a second nipping point located downstream with respect to the discharging position in the sheet-conveying direction, wherein the sheet conveyer includes:

a first roller pair located at a position corresponding to the first nipping point, the first roller pair being configured to nip the sheet being fed thereto and convey the nipped sheet downstream in the sheet-conveying direction by rotating; and a second roller pair located at a position corresponding to the second nipping point, the second roller pair being configured to nip the sheet conveyed by the first roller pair and convey the nipped sheet downstream in the sheet-conveying direction by rotating, and wherein the controller is configured to control, in a first case, in which the sheet in the initial arrangement is located at a position to be nipped by the first roller pair and by the second roller pair, the period to be shorter than the period in a second case, in which the sheet in the initial arrangement is located at a position to be nipped by the first roller pair but is not nipped by the second roller pair.

4. The image forming system according to claim 3, wherein, in the second case, the controller is configured to control the length of the period based on a distance between a frontal edge of the sheet in the determined initial arrangement and the first nipping point such that the longer the distance is determined to be, the longer the controller controls the period to be.

5. The image forming system according to claim 1, wherein the plurality of nipping points include:

a first nipping point located upstream with respect to the discharging position in the sheet-conveying direction; and a second nipping point located downstream with respect to the discharging position in the sheet-conveying direction, wherein the sheet conveyer includes:

a supporting surface configured to support the sheet being conveyed;

a roller pair located at a position corresponding to the first nipping point, the first roller pair being configured to nip the sheet being fed thereto and convey the nipped sheet downstream in the sheet-conveying direction by rotating; and a sheet presser located at a position corresponding to the second nipping point, the sheet presser being configured to press the sheet conveyed by the first roller pair toward the supporting surface, and wherein the controller is configured to control, in a first case, in which the sheet in the initial arrangement is located at a position to be pressed toward the supporting surface by the sheet presser, the period to be shorter than the period in a second case, in which the sheet in the initial arrangement is located at a position not to be pressed by the sheet presser with a frontal edge of the sheet being located upstream with respect to the sheet presser in the sheet-conveying direction.

6. The image forming system according to claim 5, wherein, in the second case, the controller is configured to control the length of the period based on a distance between a frontal edge of the sheet in the determined initial arrangement and the first nipping point such that the longer the distance is determined to be, the longer the controller controls the period to be.

7. The image forming system according to claim 1, wherein the plurality of nipping points include an upstream-side nipping point located upstream with respect to the discharging position in the sheet-conveying direction, and wherein the controller is configured to control the length of the period based on a relative position of a specific part of the sheet, on which the image is formed in the image-forming prior to being inverted by the inverting mechanism, the relative position being a position of the specific part of the sheet in the initial arrangement relative to the upstream-side nipping point.

8. The image forming system according to claim 7, wherein the controller is configured to control, in a case, in which the specific part of the sheet in the initial arrangement is located at an actable position, the actable position being a position where the sheet is acted upon by a force produced at the upstream-side nipping point, the period to be longer than in a case, in which the specific part of the sheet in the initial arrangement is not located at the actable position.

9. The image forming system according to claim 7, wherein the controller is configured to control the length of the period based on the relative position and an amount of the ink discharged at the specific part on the first side of the sheet in the image-forming prior to being inverted.

10. The image forming system according to claim 1, wherein the controller is configured to control the length of the period based on an amount of the ink discharged to form at least a part of the image on the sheet in the image-forming prior to being inverted.

11. The image forming system according to claim 1, further comprising:

a carriage, on which the recording head is mounted, the carriage being configured to move in a direction intersecting with the sheet-conveying direction, wherein the controller is configured to control the carriage, when a frontal edge of the sheet in the initial arrangement is determined to be located downstream with respect to the discharging position, to locate the recording head together with the carriage outside a pathway for the sheet to be conveyed.

12. A method to control an image forming system, the image forming system comprising:

a recording head configured to discharge ink to form an image on a sheet;

a sheet conveyer configured to convey the sheet nipped at a plurality of nipping points in a sheet-conveying direction, the plurality of nipping points being located at positions upstream and downstream in the sheet-conveying direction with respect to a discharging position for the recording head to discharge the ink toward the sheet, the sheet conveyer being configured to convey the sheet fed from upstream to downstream in the sheet-conveying direction; and an inverting mechanism configured to invert the sheet, having been conveyed by the sheet conveyer in a posture with a first side thereof facing the recording head, to refeed to the sheet conveyer in a posture with a second side thereof facing the recording head, the method comprising:

determining an initial arrangement of the sheet in the sheet conveyer, the initial arrangement being an arrangement where image-forming on the second side of the sheet after being refed to the sheet conveyer starts; and controlling a length of a period between time, when image-forming on the first side of the sheet being conveyed by the sheet conveyer in the posture with the first side facing the recording sheet is completed, and time, when the image-forming on the second side of the sheet inverted by the inverting mechanism and refed to the sheet conveyer starts, based on the determined initial arrangement of the sheet in the sheet conveyer.

* * * * *